US006032451A

United States Patent [19]

Dinkelmann et al.

[11] Patent Number: 6,032,451

[45] Date of Patent: Mar. 7, 2000

[54] SPINNING MACHINE WITH CONDENSING SUCTION ROTOR FOR A DRAFTING FRAME

[75] Inventors: Friedrich Dinkelmann, Rechberghausen; Andreas Olbrich, Kirchheim, both of Germany

[73] Assignee: Zinser Textilmaschinen GmbH, Ebersbach/Fils, Germany

[21] Appl. No.: 09/285,584

[22] Filed: Apr. 2, 1999

[30] Foreign Application Priority Data

Apr. 3, 1998 [DE] Germany ..... 198 15 051

[51] Int. Cl.[7] ..... D02G 3/36

[52] U.S. Cl. ..... 57/315; 57/6; 57/75; 57/76; 57/328

[58] Field of Search ..... 57/6, 75, 76, 315, 57/328

[56] References Cited

U.S. PATENT DOCUMENTS

| | | | |
|---|---|---|---|
| 4,583,355 | 4/1986 | Vignon | 57/5 |
| 4,757,680 | 7/1988 | Berger et al. | 57/328 |
| 5,085,046 | 2/1992 | Fehrer | 57/315 |
| 5,090,192 | 2/1992 | Stahlecker | 57/328 |
| 5,228,281 | 7/1993 | Stahlecker | 57/315 |
| 5,243,813 | 9/1993 | Stahlecker | 57/328 |
| 5,651,244 | 7/1997 | Lucca et al. | 57/75 |

FOREIGN PATENT DOCUMENTS

| | | |
|---|---|---|
| 0 162 787 | 11/1985 | European Pat. Off. . |
| 1 490 473 | 10/1965 | France . |

*Primary Examiner*—William Stryjewski
*Attorney, Agent, or Firm*—Herbert Dubno

[57] ABSTRACT

A spinning machine having a drafting frame, a condensing unit at the downstream side of the drafting frame and a spinning station for winding up the yarn and imparting twist to the roving in forming the yarn. The condensing unit comprises a disk-shaped suction rotor oriented in a plane tangent to the output rollers of the drafting frame. A limited compaction zone is formed by a shield within a suction rotor and designed to apply suction only to a limited portion of the perforated periphery thereof. The pressing roller bears against the suction rotor at the downstream side of the compaction zone.

15 Claims, 3 Drawing Sheets

1
2
3
4
8
10
24
11'
14
46
26
25
18
21
22
30
29
32
44
43
40
42
45
41

6
2
1
3
4
8
B
10
11'
17
23
24
15
16
46
40
43
32
44
A
42
41

SPINNING MACHINE WITH CONDENSING SUCTION ROTOR FOR A DRAFTING FRAME

FIELD OF THE INVENTION

Our present invention relates to a spinning machine having a drafting frame provided with suction rotors as condensing and compacting units for the drafted roving produced by the drafting frame. More particularly, the invention relates to a spinning machine which has a drafting frame and spindles downstream of the drafting frame for winding up and twisting the roving received from the drafting frame and suction rotors with peripheral arrays of perforations between the drafting frame and the spindles for compacting the roving at least in part by sucking the fibers of the roving toward the perforated periphery or circumference of the suction rotor. It will be understood, in this regard that the suction rotor has, in addition to perforations along its circumference, means for generating a suction in the interior of the rotor.

BACKGROUND OF THE INVENTION

A spinning machine having a drafting frame and spindles of this type is described in EP 0 162 787 B1. The drafting frame of this spinning machine has disk-shaped suction rotors located downstream of the drafting zones and onto which the fiber rovings pass to compact the roving. This compaction is formed at least in part by the sucking of the fibers forming the roving onto a small track of the perforations which are provided in a row on the circumference of the rotor. In some of the embodiments described in this reference, the axis of rotation of the suction rotor is inclined so that the plane of the perforations of the rotor lie in the plane tangent to the normally inclined output roller pair stretching rolls of the drafting frame. Two rovings supplied next to one another from respective paths of the drafting frame can be combined, e.g. to a core yarn, on this suction rotor and, via a false twist spindle, a false twist can be imparted to the yarn which is then wound up into a bobbin.

Because of the location of the suction rotor in this assembly, at least one of the rovings is compelled to travel in an incompletely stabile state, i.e. without twisting, over a relatively long path. In this region the roving can be damaged. For example, its fibers can be entrained in air vortices or pulled apart by spurious air currents. There is also a tendency for the fibers to project outwardly from the roving so that the product has a high degree of hairiness. Furthermore, the long distance which the roving is compelled to travel from the rotor to the spindle or from the drafting frame to the rotor can interfere with the uniformity of the roving. Finally, tension can be applied to the roving by the ring-spinning spindles where the roving lies against the suction rotor so as to be detrimental to the compaction of the roving.

OBJECTS OF THE INVENTION

It is, therefore, the principal object of the present invention to provide an improved spinning machine whereby the drawbacks outlined above of the earlier systems can be obviated.

More specifically, it is an object of the invention to provide a spinning machine having a reduced travel distance for the roving from the drafting frame to the suction rotor so that damage to the roving along its path to the suction rotor can be minimized.

Still another object of the invention is to provide a spinning machine of the type described which prevents damage by tension applied by the ring-spinning units to the yarn downstream of the condensing rotor even over long stretches between the condensing rotor and the ring-spinning units.

Yet another object of the invention is to provide a spinning machine which affords optimum compaction of the roving on the condensing rotor.

SUMMARY OF THE INVENTION

These objects are attained, in accordance with the invention, in a spinning machine which comprises:

a drafting frame for receiving rovings and formed with a plurality of roller pairs successively engaging respective rovings for drafting same to produce drafted rovings, the roller pairs including a pair of output rollers having a nip through which a respective roving passes and a plane tangent to the output rollers at the nip;

a respective spinning station receiving each of the rovings from the drafting frame and including a spindle rotatable to twist the respective roving and wind the respective roving into a yarn body;

a condensing suction rotor at each of the stations for compacting the roving received from a respective output roller pair and supplying the compacted roving to the respective spinning station, the suction rotor having a circumferential row of perforations lying in a plane and being mounted for rotation about an axis such that the perforations lie substantially in the plane tangent to the output rollers at the respective nip, the suction rotor being connected to a suction source for generating suction over a limited portion of the circumference of the rotor along a compaction zone; and a respective pressing roller having an axis parallel to the axis of the suction rotor and bearing upon the circumference of the suction roller at a downstream end of the compaction zone, the roving passing between the pressing roller and the suction rotor.

According to the invention, with the system described, the travel of the roving in an unsupported manner between the drafting frame and the suction rotor is minimized and the tension applied by the spinning station is applied at a location remote from the compaction zone.

The roving passes as bands from the output roller pair of the drafting frame at each station, the band having a width which is a multiple of its thickness. The perforations open toward the band in the direction of the width of the band so that as each roving passes onto the perforated circumference of the respective suction rotor, the band is condensed in its width and the suction serves to compact each roving highly in the direction perpendicular to the width direction. The position of the plane of the perforations is so that it is substantially tangential to the output rollers of the drafting frame at the nip or clamping line at which the roving is engaged between two output rollers and ensures compaction in spite of back and forth movement of the roving in its plane as is common with such rovings.

When a very narrow rotor is provided, i.e. the suction rotor has a flat configuration with a height equal to a small fraction of its diameter, there is the additional advantage that the suction rotor or disk can engage in the crevice between the two output rotors. This is facilitated according to the invention by providing the perforations along the cylindrical periphery flanked by beveled edges.

It has been found to be advantageous to lead the yarn away from the periphery of the suction rotor or the periphery of a pressing roller in contact with that periphery to a location laterally opposite from the axis of rotation of the suction rotor and in inclined direction so that the yarn will roll off the periphery of the suction rotor or the pressing roller. In this manner a twist is imparted to the yarn which is a false twist.

However, a true twist can be imparted to the yarn as well when the sense of rotation of the true twist and the sense in which the false twist rotates coincide at the side at which the false twist rolls off the rotor or roller. The direction in which the false twist rotates can be selected by the choice of the rotation direction of the suction rotor or the pressing roller from which the yarn falls off and the sense in which the yarn is looped therearound, with respect to the sense of the imparted true twist. By thus permitting a travel of the true twist imparted to the yarn to the point at which the yarn falls off the suction rotor or pressing roller, yarn breakage is reduced and the binding of projecting fibers is improved, thereby reducing the hairiness of the yarn which is generated.

It has been found to be advantageous, when the yarn is permitted to roll off the suction rotor or pressing roller described to increase the surface supporting the yarn rolling off, e.g. by cylindrically increasing the length of the suction rotor or pressing roller at least in the direction in which the yarn rolls off. When the suction rotor is thus elongated, of course, one loses the advantage of being able to fit the suction rotor into the crevice between the rollers of the output roller pair.

It is, however, possible to increase the length of the pressing roller and to provide the pressing roller so that it engages the periphery of the suction roller at a location remote from the location which the suction rotor fits into the crevice between the output rollers. In this case there is the advantage of a pick up of the roving close to the nip of the output rollers with the advantage of supporting the false twist as it passes off the condensing device.

To achieve the effective roll off of the yarn from the suction rotor or its pressing roller, it has been found to be advantageous to provide the suction rotor or the pressing roller in its yarn roll off with a jacket of a high coefficient of friction, e.g. a rubber jacket or a jacket of rubber-like material.

The invention can be used for producing a simple yarn, i.e. a yarn made up only of a single roving received from the drafting frame and passing over the suction rotor or a yarn in which two such rovings join and are together condensed as has been described. However, it can also be used for the production of core yarn.

In a core yarn according to the invention, a core thread is embedded in the roving which is twisted or into each of the two or more rovings which are twisted together. It has been found to be advantageous to lay the core thread into the roving at the center of the band, i.e. upstream of the condensing or compaction zone. In that case, the embedding of the core thread may be complete, i.e. the core thread may be completely and uniformly covered by the roving fibers over the entire length thereof.

It will be understood that in earlier core yarn systems it was not uncommon for the core thread to remain exposed even after spinning of the yarn in a ring-spindle station.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
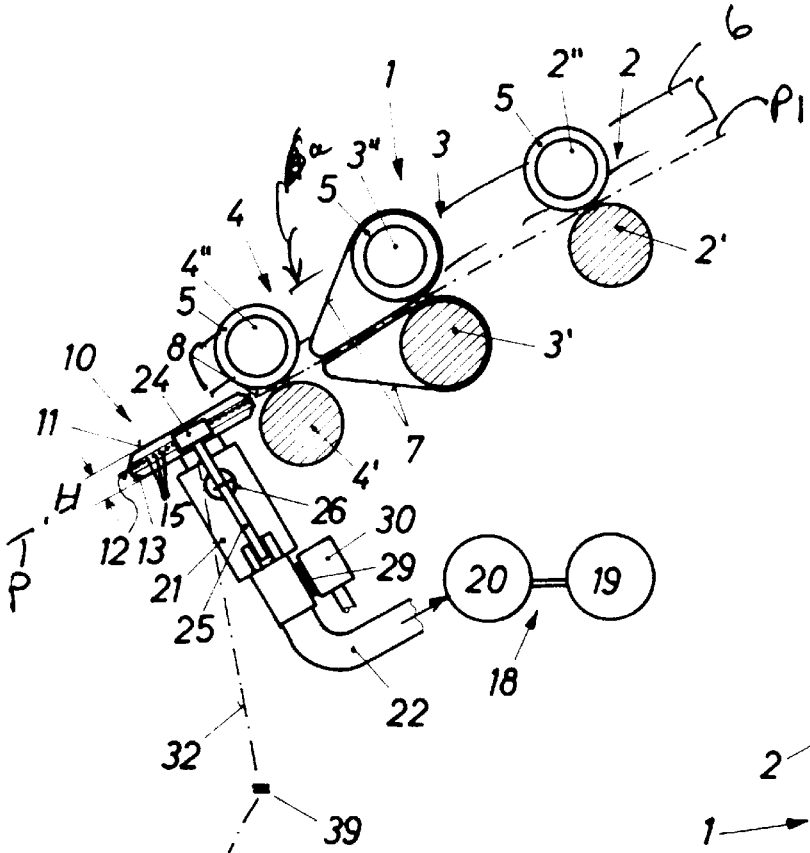
FIG. 1 is a transverse section through a spinning machine having ring-spinning stations and which has a compaction or condensing unit in accordance with a first embodiment of the invention.

The spinning machine shown in FIG. 1 comprises a drafting frame 1 of conventional design with an input pair of rollers 2, a middle pair of rollers 3 and an output pair of rollers 4. The lower rollers 2', 3' and 4' of these pairs of rollers are steel rollers which can extend the full length of the stretching frame and are driven at successively higher peripheral speeds in the downstream direction so as to draw or draft the roving 8 between the roller pairs. In the working positions, i.e. the positions in which the rollers 2', 3' and 4' engage each roving 8, corresponding to a respective spinning station, the roller rails 2', 3' and 4' may be milled or knurled to increase the grip of the respective rollers upon the roving.

Figure 6:
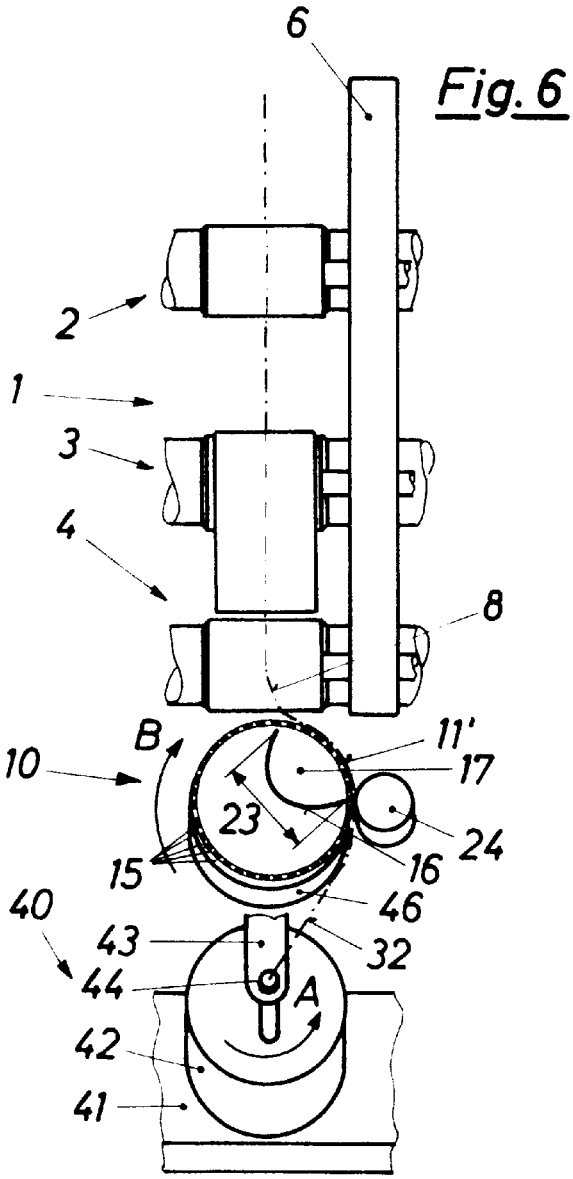
FIG. 6 is a plan view of a portion of the apparatus shown in FIG. 5 and partly broken away.

The upper rollers 2", 3" and 4" may be twinned rollers, i.e. may be mounted on an arm 6 shown only diagrammatically in FIGS. 1 and 6, so that one such upper roller is located on each side of the arm 6. The arm 6 is a weighting or loading arm and may be spring-loaded in the direction of the arrow A in FIG. 1 to thereby press the upper rollers 2", 3" and 4" against the roving 8 and the respective lower roller 2', 3', 4' supporting same.

The rollers 2" and 4" are provided with elastic jackets 5 and all of the rollers carried by each arm 6 may be mounted thereon with play so as to be self-orienting. The rollers 3' and 3" of the middle pair 3 can be equipped with belts 7 which are also composed of elastic material and are guided over belt cages (not shown). The drafting frame 1 delivers the drafted but untwisted rovings 8, with the desired fineness, as respective bands at the output side of the nip of the output pair of rollers 4. Other drafting frame designs or configurations can, of course, also be used.

Figure 3:
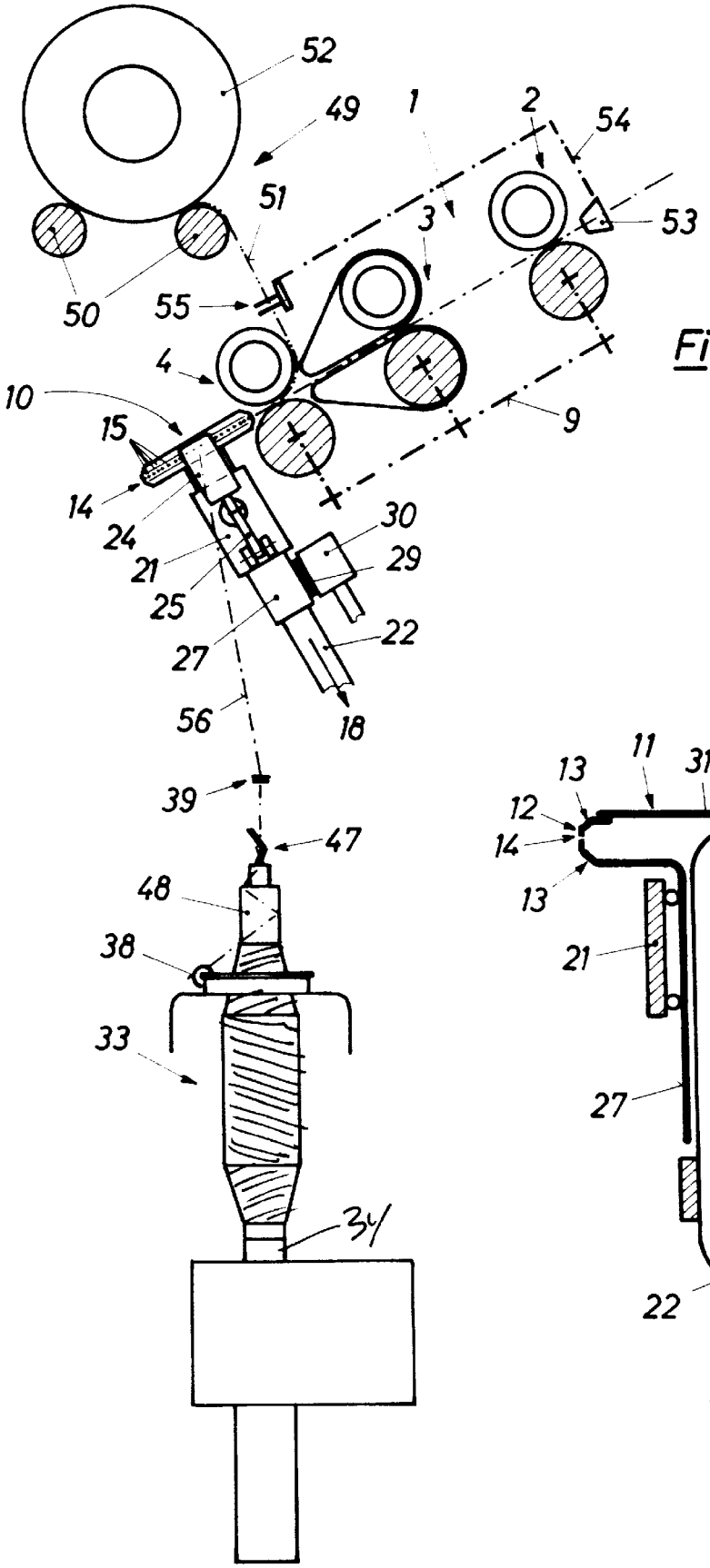
FIGS. 3 is a view similar to FIG. 1 showing an apparatus for the production of a core yarn according to the invention.

The lower rollers 2', 3' and 4' can be driven by a conventional drive at their respective peripheral speeds or by separate drives as has been represented diagrammatically by the dot-dash lines 9 in FIG. 3.

Downstream of the drafting frame 1, a compaction unit 10 is provided for each of the spinning stations and in the embodiments of FIGS. 1–4, that compaction or condensing unit 10 comprises a rotating disk-shaped suction rotor 11 which is driven and has only a limited height H, which is a small fraction of its diameter. The small cylindrical periphery 12 of this suction rotor disk is flanked by bevels 13 and is formed with a row of perforations 14 in the form of small suction orifices 15.

Because of the disk shape and the bevels, the suction rotor 11 is sufficiently slender that it can extend into the crevice between the rollers 4' and 4" of the output pair 4 on the output side so that the untwisted and unstable roving 8 can be picked up after traveling the shortest possible path from the nip between these rollers.

Figure 2:
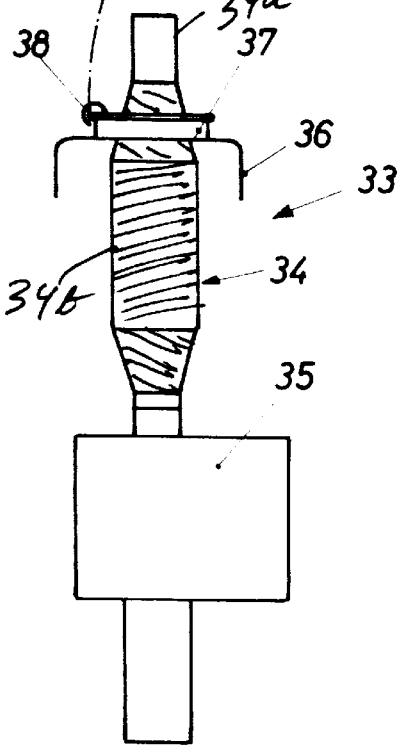
FIG. 2 is a plan view of a portion of the machine of FIG. 1.
Figure 2:
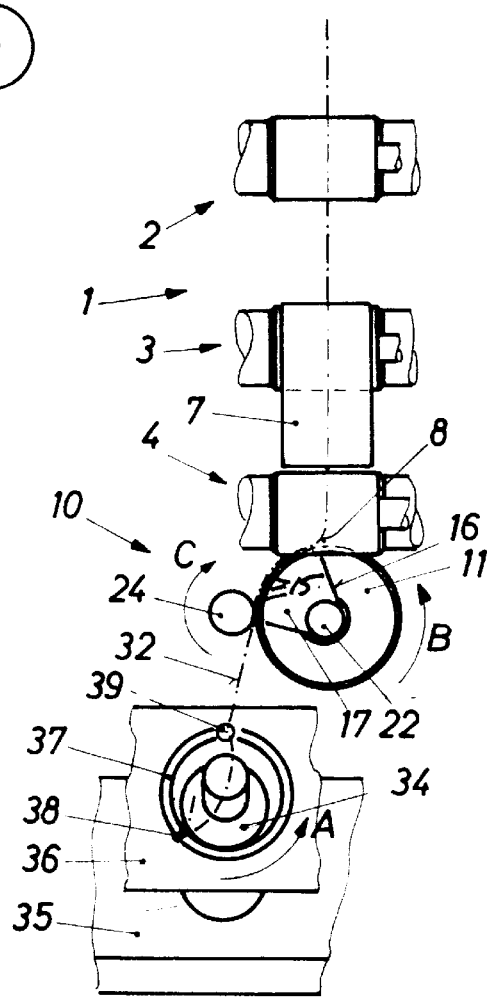

The orifices 15 lie in a plane P which can be tangential to the rollers 4', 4" at their nip. Usually, since the upper roller 4" is offset forwardly of the lower roller 4', this tangential plane will not coincide with the plane P1 of the roving 8, i.e. the stretching plane. In FIG. 2 the suction rotor 11 has been sectioned in this plane to make the perforations 15 more readily visible.

Within the suction rotor 11 (FIG. 2) a suction chamber 17 is defined by a shield 16 and is evacuated by a suction source 18 via the suction pipe 22 which runs along through the bearing housing 21 of the suction rotor 11. The suction chamber 17 thus opens at the orifices 15 over only a limited portion of the perforated periphery 14 of the suction rotor 11, corresponding to a compaction zone 23 (FIG. 6). The suction effect is thus supplied only in the region of this compaction zone 23.

The compaction zone 23 is so located that it corresponds to the point at which the suction rotor 11 is closest to the output roller pair 4 so that the suction is applied immediately to the roving emerging from the nip of this pair. At the opposite end of the compaction zone 23, a pressing roller 24 bears against the periphery of the suction rotor 11.

The pressing roller 24 is journaled on an arm 25 swingably mounted on the bearing housing 21 of the suction rotor 11. The pressing roller 24 is urged against the periphery of the suction rotor 11 by a tension spring 26 anchored to the bearing housing and on the arm 25. The pressing roller 24 has an elastic jacket. The suction rotor 11 with its suction chamber 17 and the pressing roller 24 form the respective condensing unit 10.

Figure 4:
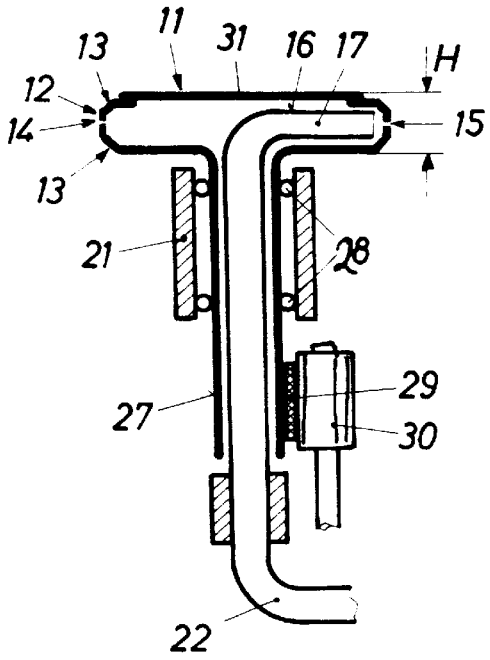
FIG. 4 is a longitudinal section through the suction rotor of FIGS. 1–3.

As can be seen from FIG. 4 the shaft 27 can be hollow. The shaft 27 is rotatable via ball-bearings 28 in the bearing housing 21 and at its lower end is engaged by a tangential belt or apron 29 pressed by a pressing roller 30 against the shaft 27. The stationary suction pipe 22 can thus extend through the hollow shaft 27 to the suction chamber 17 which is of a sufficient width to encompass the entire compaction zone 23.

The suction rotor 11 has a diameter of, for example, 50 mm and can be closed by a removable cover 31. The peripheral speed of the suction rotor 11 corresponds to the delivery speed of the output roller pair or is slightly higher. As a result the angular speed of the suction rotor 11 is less.

For twisting and winding up the yarn 32 supplied by the compaction device 10 of FIGS. 1–3, a conventional ring-spinning station 33 is provided. It will be understood that a large number of such stations can be spaced apart along each side of the spinning machine and each station can be fed with one of the rovings from the drafting frame. The ring-spinning portion of the machine comprises a spindle 34 specific to each station and whose drive is received in a spindle rail 35 common to all of the drives and bearing systems of all of the spindles on the respective side of the machine. A ring rail 36 is movable up and down along the spindles and has a spinning ring 37 surrounding each spindle and on which a traveler 38 orbits. The yarn 32 runs from the condensing or compacting device via a thread guide 39 to the traveler 38.

In operation the drafting frame 1 delivers a roving from the output roller pair 4 in the form of a strip which has a width depending upon the diameter of the sliver fed to the drafting frame. In the width direction this roving is picked up by the compaction zone 23 of the suction rotor 11 and the suction applied at the perforated periphery 14 draws the fibers of the roving together to deliver the roving, compacted by the suction to the nip between the suction rotor 11 and the pressing roller 24.

At this point the suction terminates and the yarn is drawn downwardly at an angle (see FIG. 2) and becomes twisted by the twist rising up from the ring-spinning station 33 to the nip between the rotor 11 and roller 24. The yarn is wound in a bobbin or yarn body on the tube 34*a,* the bobbin being represented at 34*b* in FIG. 1.

Figure 5:
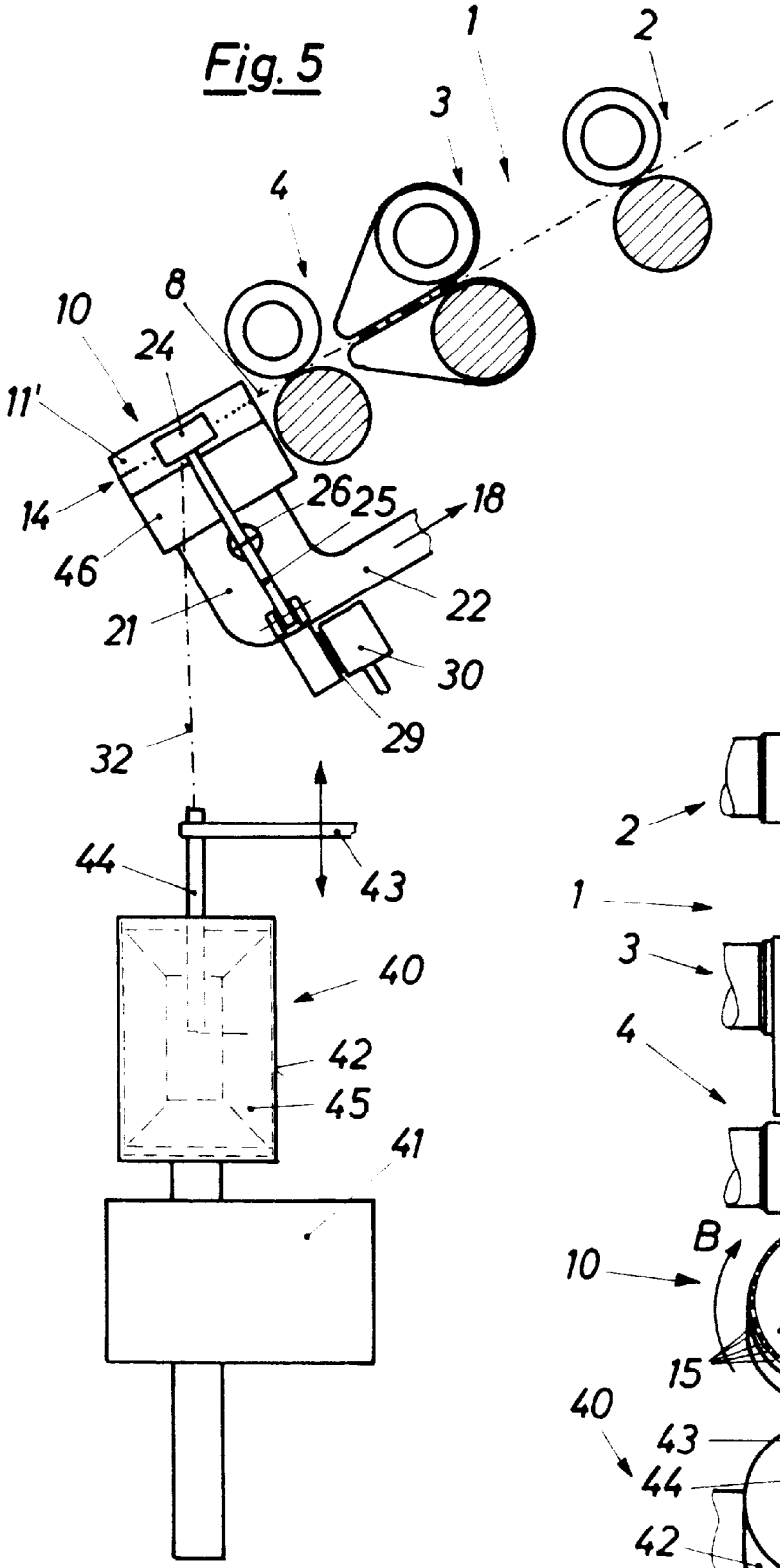
FIG. 5 is a view similar to FIG. 1 of an apparatus in which the spinning unit is a pot-spinning unit.

In the embodiment of FIGS. 5 and 6, the suction rotor 11' is cylindrical and of greater height so that it is not able to penetrate into the crevice between the pair of output rollers 4. It nevertheless cooperates with a pressing roller 24. In this embodiment the yarn 32 is spun in a pot-spinning unit 40 which comprises a spinning pot 42 mounted in the pot rail 41 and having an arm 43 which is vertically shiftable and carries the thread guide tube 44 which deposits the spinning cake 45 in the spinning pot. The pot-spinning apparatus can correspond, for example, to that shown in U.S. Pat. No. 5,613,355.

The suction rotor 11' and the pressing roller 24 are so located with respect to the subsequent ring-spinning device 33 or the inlet opening to the thread guide tube 44 of the pot-spinning unit that the yarn 32, upon withdrawal from the nip between the suction rotor and the pressing wheel, is pulled over the periphery of the suction rotor. As can be seen from FIG. 6, the yarn 32 therefore rolls off over the cylindrical surface of the suction roller and is thus twisted, especially as it rolls off over its lower edge. This twist is a false twist. The rotational sense of this false twist can, however, be so selected by the choice of the rotational sense of the suction rotor 11' as to support the jump of the true twist imparted to the yarn 32 by the ring-spinning station 33 or by the pot-spinning station 40 to the nip between the rollers 24 and 11'.

The imparting of a false twist to support the true twist can be promoted by providing the periphery of the suction rotor 11 and at least in its lower region where the yarn 32 rolls off from it, with a jacket 46 of a high coefficient of friction. The yarn can thus have a so-called S-twist whereby the spinning pot 42 (FIG. 6) is driven in the direction of arrow A and the suction rotor 11' runs in the opposite direction as indicated by arrow B. When the production of the yarn with a Z-twist is required, not only must the directions of the spinning pot and the suction roller be reversed, but the compaction zone 23 in the suction rotor 11' and the pressing roller 24 must be shifted to the opposite side from that shown, namely, to the left side. The shield 16 can be swung by 90° in a counterclockwise sense for this purpose and, if desired, a mount for the pressing roller 24 can be provided additionally on the opposite side of the bearing housing 21 so that changeover in positions is easily achieved.

The possibility of supporting the natural twist by a false twist imparted to the yarn can also be achieved with a suction rotor 11 of the type described in connection with FIGS. 1–3. Since the surface area of the periphery of this suction rotor 11 may be too small to ensure the desired roll off effect in producing the false twist, it is desirable here to cause the yarn 32 to roll off the pressing roller 24. In this case, the pressing roller which would otherwise have a small height to engage the narrow perforated circumference of the pressing roller can be increased in length downwardly. Elastic jackets with a higher coefficient of friction than steel can promote the roll off effect and can be provided for the pressing roller 24 if desired.

In any case the suction rotor 11 and pressing roller 24 must be so configured that the yarn 32 can roll off and form a false twist. In this case, the pressing roller 24 is rotated in the clockwise sense C (FIG. 2), suction rotor 11 is driven in the counterclockwise sense B and the spindle 34 is driven in the counterclockwise sense (arrow A in FIG. 2). The suction rotor here rotates in the same sense as the spindle and the pressing roller 24 is driven in the opposite sense.

FIG. 3 also shows that the spinning spindle 34 can be designed for balloonless spinning or spinning with a reduced thread balloon formation. To this end, the spindle can be equipped with a spinning finger 47 which can capture the oncoming yarn 56 directly below the thread guide 39 and guided onto the winding sleeve or tube 48 and thence through the traveler 38 without balloon formation.

The device of the invention can also be used to make a core yarn and for that purpose a core thread feeder 49 can be provided. A core yarn is a yarn in which a preferably endless synthetic thread, forming the core, is surrounded or enveloped by fibers from a roving, usually cotton fibers and/or wool fibers, over the length of the core.

As will be apparent from FIG. 3 the drafting frame 1 can thus be equipped with two feed rollers 50 which can extend the full length of the drafting frame and on which a core thread spool 52 can be mounted so that the core thread 51 can be delivered from the spool.

The core thread is drawn over one of the rollers 50, which are to be driven at substantial lower peripheral speed as the output rollers 4 so that the core thread 51 is laid in stretched condition and centrally to the roving at the inlet side of the upper roller 4".

The core thread 51 is held in stretched condition until winding off the yarn from the bobbin 34*b* whereupon it draws together elastically and forms a bulky yarn. The position of the core thread 51 may be set in accordance with the sliver inlet funnel position (i.e. the position of the funnel 53) as represented by the dot-dash line 54 so that the core thread will always be centered on the roving in spite of possible back and forth movement of the roving. Since the core thread is laid into the relatively wide rovings upstream of the nip of the last pair of drafting rolls, the fibers are drawn relatively tightly therearound in the condensing unit 10 and thus completely and tightly cover the core thread.

The various parts of the apparatus, namely the drafting frame 1, the condensing device 10, the spinning units 33 or 40, the balloonless or balloon operation and the core thread insertion unit can be combined in various ways in accordance with the principles of this invention.

We claim:

1. A spinning machine comprising:

a drafting frame for receiving rovings and formed with a plurality of roller pairs successively engaging respective rovings for drafting same to produce drafted rovings, said roller pairs including a pair of output rollers having a nip through which a respective roving passes and a plane tangent to said output rollers at said nip;

a respective spinning station receiving each of said rovings from said drafting frame and including a spindle rotatable to twist the respective roving and wind the respective roving into a yarn body;

a condensing suction rotor at each of said stations for compacting the roving received from a respective output roller pair and supplying the compacted roving to the respective spinning station, said suction rotor having a circumferential row of perforations lying in a plane and being mounted for rotation about an axis such that said perforations lie substantially in said plane tangent to said output rollers at the respective nip, said suction rotor being connected to a suction source for generating suction over a limited portion of the circumference of said rotor along a compaction zone; and a respective pressing roller having an axis parallel to the axis of said suction rotor and bearing upon said circumference of said suction roller at a downstream end of said compaction zone, the roving passing between said pressing roller and said suction rotor.

2. The spinning machine defined in claim 1 wherein said suction rotor is generally flat with a height equal to a small fraction of its diameter.

3. The spinning machine defined in claim 2 wherein said circumference provided with said perforations is cylindrical and is flanked by beveled edges.

4. The spinning machine defined in claim 3 wherein said suction rotor is received in a crevice between said output rollers close to said nip.

5. The spinning machine defined in claim 1 wherein a direction in which the yarn is withdrawn from the periphery of one of said suction rotor and said pressing roller is laterally offset from the axes of rotation of said one of the suction rotor or the pressing roller and is inclined, the directions of rotation of the suction rotor and the pressing roller and the way in which they are looped by the withdrawn yarn being so selected that the yarn rolls off said one of the suction rotor and pressing roller in a sense generating a false twist in the yarn which coincides with the sense of a true twist imparted by said spinning station at the respective spindle.

6. The spinning machine defined in claim 5 wherein the suction rotor or the pressing roller from which the yarn rolls off is extended in the roll-off direction.

7. The spinning machine defined in claim 6 wherein the suction rotor or the pressure roller from which the yarn rolls off is formed at least in the region at which the yarn rolls off with a covering of a high coefficient of friction.

8. The spinning machine defined in claim 1 wherein said spinning station is a ring spinning station with a spindle rotatable on a spindle rail, a ring rail, a ring surrounding said spindle on said ring rail, and a traveler orbiting on said ring.

9. The spinning machine defined in claim 8 wherein said spindle is provided with means for suppressing thread-balloon formation.

10. The spinning machine defined in claim 9 wherein said means for suppressing thread-balloon formation includes a spinning finger.

11. The spinning machine defined in claim 1 wherein said spinning station is a pot-spinning station.

12. The spinning machine defined in claim 1, further comprising means for introducing a core filament into said roving upstream of said suction rotor, thereby forming a core yarn.

13. The spinning machine defined in claim 12 wherein a direction in which the core yarn is withdrawn from the periphery of one of said suction rotor and said pressing roller is laterally offset from the axes of rotation of said one of the suction rotor or the pressing roller and is inclined, the directions of rotation of the suction roller and the pressing roller and the way in which they are looped by the withdrawn core yarn being so selected that the core yarn rolls off said one of the suction rotor and pressing roller in a sense generating a false twist in the core yarn which coincides with the sense of a true twist imparted by said spinning station at the respective spindle.

14. The spinning machine defined in claim 13 wherein the suction rotor or the pressing roller from which the core yarn rolls off is extended in the roll-off direction.

15. The spinning machine defined in claim 14 wherein the suction rotor or the pressure roller from which the core yarn rolls off is formed at least in the region at which the core yarn rolls off with a covering of a high coefficient of friction.

* * * * *